US009994375B2

(12) United States Patent
Zacchi

(10) Patent No.: US 9,994,375 B2
(45) Date of Patent: Jun. 12, 2018

(54) MODULAR PACKING SYSTEM

(76) Inventor: Luca Zacchi, Varzo (IT)

( * ) Notice: Subject to any disclaimer, the term of this patent is extended or adjusted under 35 U.S.C. 154(b) by 774 days.

(21) Appl. No.: 13/520,250

(22) PCT Filed: Dec. 24, 2010

(86) PCT No.: PCT/IT2010/000513
§ 371 (c)(1),
(2), (4) Date: Jul. 2, 2012

(87) PCT Pub. No.: WO2011/080788
PCT Pub. Date: Jul. 7, 2011

(65) Prior Publication Data

US 2013/0036707 A1 Feb. 14, 2013

(30) Foreign Application Priority Data

Dec. 30, 2009 (IT) ..... MN2009A0027

(51) Int. Cl.
*B65D 71/00* (2006.01)

(52) U.S. Cl.
CPC ..... *B65D 71/0096* (2013.01); *B65D 2571/00043* (2013.01); *B65D 2571/00111* (2013.01)

(58) Field of Classification Search
CPC ..... B65D 19/06; B65D 19/40; B65D 19/44; B65D 19/385; B65D 21/0222; B65D 21/0223; B65D 71/0088; B65D 71/0092
USPC ..... 206/508, 503, 386
See application file for complete search history.

(56) References Cited

U.S. PATENT DOCUMENTS 3,389,830 A * 6/1968 Smith ..... B65D 21/0222 206/504
3,393,858 A * 7/1968 Heel ..... B65D 5/4295 217/42
3,616,943 A * 11/1971 Brink ..... B65D 21/0235 206/508

(Continued)

FOREIGN PATENT DOCUMENTS

EP 0 301 445 A2 2/1989
WO 96/24530 A1 8/1996

OTHER PUBLICATIONS

International Search Report, dated May 6, 2011, from corresponding PCT application.

*Primary Examiner* — Ernesto Grano
(74) *Attorney, Agent, or Firm* — Young & Thompson

(57) ABSTRACT

A modular packing system includes a pallet exhibiting a continuous and unperforated support surface affording a plurality of seating features distributed thereon, a plurality of containers of base measurements as submultiples of the pallet dimensions and constant height so as to form even layers of uniform height, and an uppermost cover element for positioning on top of a final layer of containers and equipped with a first pair of belts engageable to corresponding belt portions which, in turn, engage with a second pair of belts associated to the pallet. Each container exhibits a lower base surface affording raised features configured to engage in seating features in the pallet support surface. Each container further exhibits a cover element exhibiting a plurality of seating features, analogous in conformation and positioning to the seating features in the pallet support surface, so as to form another support and engagement surface for a subsequent layer.

16 Claims, 9 Drawing Sheets

(56) References Cited

U.S. PATENT DOCUMENTS 4,653,651 A * 3/1987 Flum ..... B65D 71/70 108/53.1
4,735,321 A * 4/1988 Day ..... B65D 19/0036 100/2
4,765,252 A * 8/1988 Shuert ..... B65D 15/22 108/55.1
4,865,202 A * 9/1989 Day ..... B65D 19/0018 100/2
5,108,255 A * 4/1992 Cornacchia ..... B65G 61/00 414/744.2
5,121,877 A * 6/1992 Bodary ..... B65D 5/4295 206/503
5,259,509 A * 11/1993 Boal, Jr. ..... B65D 11/08 206/508
5,758,771 A * 6/1998 Rose ..... B65D 19/44 206/386
6,024,223 A * 2/2000 Ritter ..... B65D 19/18 206/386
6,530,476 B1 * 3/2003 Overholt ..... B65D 71/0096 108/55.3
6,554,133 B1 * 4/2003 Kropf ..... B65D 85/38 206/320
7,163,122 B2 * 1/2007 Elder ..... B65D 19/18 220/669
7,222,740 B2 * 5/2007 Garfinkle ..... B65D 19/06 220/1.5
8,851,287 B2 * 10/2014 Becklin ..... B65D 21/0224 108/12
2003/0146272 A1 * 8/2003 Kent ..... B65D 5/0015 229/171
2004/0035872 A1 2/2004 Garfinkle
2006/0254946 A1 11/2006 Becklin
2007/0119122 A1 * 5/2007 Shepps ..... B65D 19/06 53/396

* cited by examiner

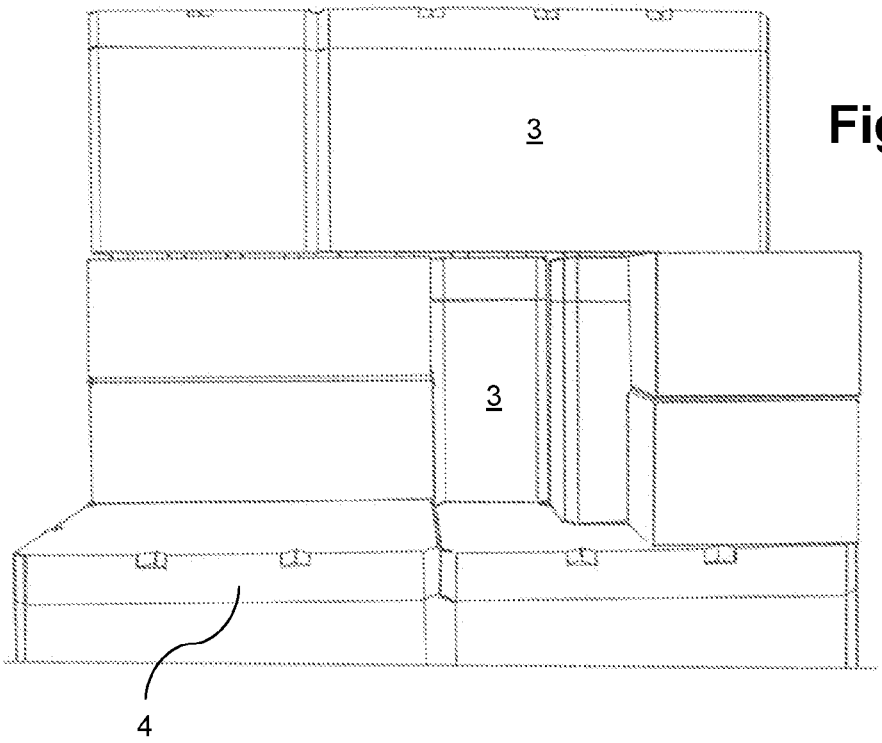
Fig 6.
Fig 7.
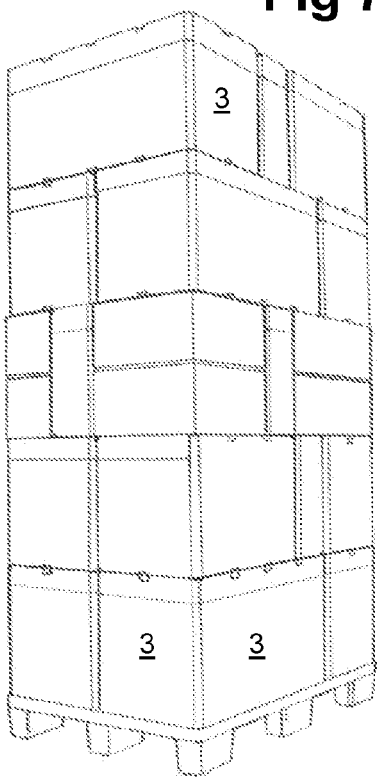
Fig 8.
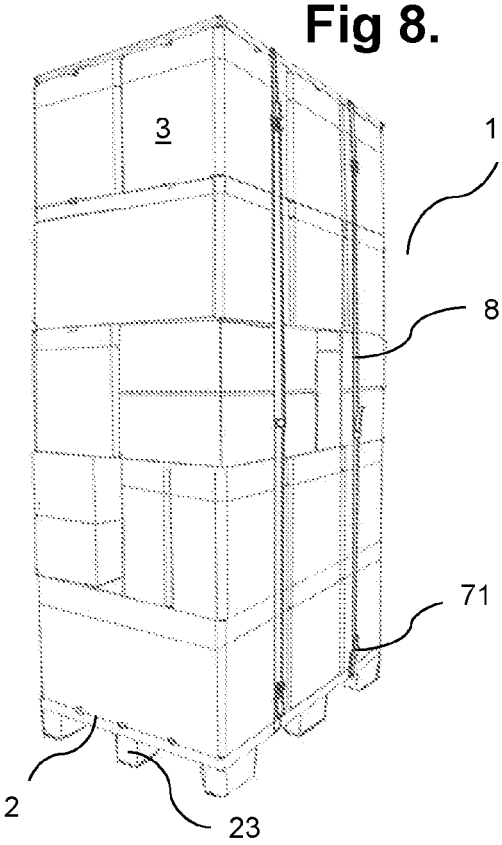

MODULAR PACKING SYSTEM

BACKGROUND OF THE INVENTION

Field of the Invention

The present invention relates to a modular packing system particularly suited to transport of delicate and perishable products including, for example, pharmaceuticals, medicines, and other substances that require protected and safe handling and transport, insulated from the surrounding environment.

Description of the Related Art

At logistics stations of known type, diverse boxes containing products are prepared for consignment. Boxes of different dimensions are stacked on wood pallets, and when a pallet is complete the boxes are bound together by lateral wrapping using a plastic film such that the boxes are restrained in position for subsequent handling of the pallet and associated boxes using fork lift vehicles for warehouse storage or for loading into standard transport containers or road vehicles.

Pallets of known type principally comprise a lattice formed from wood slats supported above ground level by support elements such that the forks of a fork lift vehicle can be inserted into the interspace between ground and lattice for convenient handling of the pallet and load.

A plurality of problems have emerged as a result of the use of wood pallets for transport of delicate substances, including for example foodstuffs, and in particular pharmaceutical products, to the extent in some cases of compromising the integrity of the transported materials.

A first problem is a difficulty of satisfactorily stacking boxes of variable dimensions on a pallet support surface such that the load is uniformly distributed and arranged.

Frequently, boxes are not positioned directly alongside each other and voids are left between boxes because it is common practice to arrange boxes in alignment with the outside perimeter of the pallet in order to facilitate subsequent wrapping with plastic film.

A similar problem is encountered as regards vertical arrangement of boxes on pallets. Furthermore, either as a consequence of box to dimensions, or haste or inattention of an operator preparing a pallet, boxes are sometimes arranged such as to extend outside the perimeter of the pallet, resulting in damage to such boxes and associated contents during the stage of application of plastic film or resulting from impacts, even of minor entity, during handling of the pallet or when positioning pallets alongside each other.

A further problem derives from the fact that pallets must be removed and disposed of or reutilized, generating operating costs that increase the overall costs of transport and storage of the relative transported goods.

A further problem is that wood pallets deteriorate through time as a consequence of absorbing humidity, precipitation, dirt, etc., resulting in the wood slats comprising the lattice decomposing and losing mechanical strength while also becoming vectors for moulds, fungi, and viruses as possible contaminants of the boxes and box contents.

Furthermore, pallets comprising a lattice structure permit transit of humidity and cold air towards supported boxes, both in areas of contact and through voids between boxes, in some cases such as to compromise the state of preservation of the products inside the boxes, considering that the boxes used are prevalently made of cardboard. In addition, voids between boxes facilitate physical contact with the boxes, possibly resulting in degradation, tearing, perforation, wetting and/or contamination.

A further problem is that temperature changes induce condensation inside the plastic film, the condensation dripping onto and/or being absorbed by the boxes, again resulting in deterioration.

In particular, during transport of pharmaceuticals, a series of precautions must be taken such that the pharmaceuticals arrive intact and perfectly preserved.

As is known, pharmaceutical bodies generally do not consign pharmaceuticals directly to customers, instead relying on pharmaceutical transport companies which, in turn, are articulated in a sequence of levels before final dispatch in a small road vehicle for the supply, on specific request, of individual chemist's shops, hospitals, laboratories, etc.

In particular, transport of pharmaceutical products requires a series of measures and precautions to ensure arrival at a destination perfectly preserved, both as regards content and packaging.

During transport, pharmaceuticals must be maintained within a well defined and controlled temperature range and not subjected to significant impacts in order to avoid damaging boxes and packaging. Precautions must also be taken during transport to avoid breaking containers inside boxes, which may be made of glass, compromising the contents. Furthermore, pharmaceuticals must not come into contact with humidity, fungi, viruses etc. which can alter the state of preservation of boxes, packages, and might alter, deteriorate, or infect the pharmaceuticals.

As is known, pharmaceuticals exposed to temperatures outside of established limits during transport and handling are at risk of losing to their medicinal characteristics, becoming ineffective and possibly even toxic, and consequently contestable by purchasers (chemist's shops, hospitals, etc.).

Furthermore, pharmaceuticals must also be protected from light, impact, and the external environment such that packages and medicinal compounds are not at risk of damage and alteration, also considering that pharmaceutical preparation is extremely expensive and final disposal is very problematic because pharmaceuticals often contain highly polluting substances.

Finally, pharmaceuticals must also be eliminated if packages are damaged, dented, damp, etc. with consequent contestations from purchasers in relation to the pharmaceutical transport companies involved in packing and transporting the pharmaceuticals.

In addition to the issues described above, packing and transport systems of known type offer no guarantee that boxes are not removed or tampered with for theft of contents, considering that boxes are stacked on top of each other and one or more boxes can be rendered removable simply by cutting or tearing the plastic film.

Finally, pharmaceutical products and materials are currently transported using wood pallets which before use must obligatorily be subject to approval and fumigation, or other treatments, to eliminate any incidental parasites present in the wood, thus generating operating costs which inevitably increase the final cost of transported goods.

SUMMARY OF THE INVENTION

The aim of the present invention is substantially to obviate the problems of known art, eliminating the problems described above by way of a modular packing system that provides optimum handling and transport of boxes containing pharmaceuticals or other delicate products in a safe, protected, and stable manner.

A second aim of the present invention is to realize a modular packing system that provides pallets, containers, and boxes that interlock with each other, providing considerable stability even when a pallet is fully loaded.

A third aim of the present invention is to realize a modular packing system that can provide excellent preservation of products inserted into boxes and containers, and optimum preservation of boxes regarding appearance, structure, and hygiene, because humidity, fungi, and viruses are unable to contaminate the boxes during transport and/or storage.

A fourth aim of the present invention is to realize a modular packing system that provides a significant engagement between pallets and associated boxes and containers, preventing removal or tampering with boxes or containers and providing final users a guarantee that a pallet was not altered during transport.

A further aim of the present invention is to provide a modular packing system that renders pallet packing procedures relatively fast, simple, and safe while also permitting perfectly ordered insertion of various types of box and container without compromising the practicality, stability, and security of the packing system.

A further aim of the present invention is to provide a simple and to practical modular packing system which permits maximum optimization of available space, without elements extending outside the pallet profile and without wasted space, when loading a pallet with boxes and containers.

A further aim of the present invention is to provide a modular packing system wherein pallets and containers can be recycled and/or reused.

A final but not least important aim of the present invention is to provide a modular packing system of simple realization and highly functional.

The aims described above and others that will better emerge in the following description are substantially attained by a modular packing system as claimed herein below.

BRIEF DESCRIPTION OF THE DRAWING FIGURES

Further characteristics and advantages will better emerge from the detailed description of a modular packing system of the invention made herein with reference to the accompanying figures of the drawings, provided by way of non-limiting example, in which:

FIG. 6 is a perspective view of an alternative assemblage of components of the packing system of the invention;

FIG. 7 illustrates a completed assemblage of components of the packing system of the invention;

FIG. 8 illustrates the assemblage of FIG. 7 ready for transport;

Figure 11:
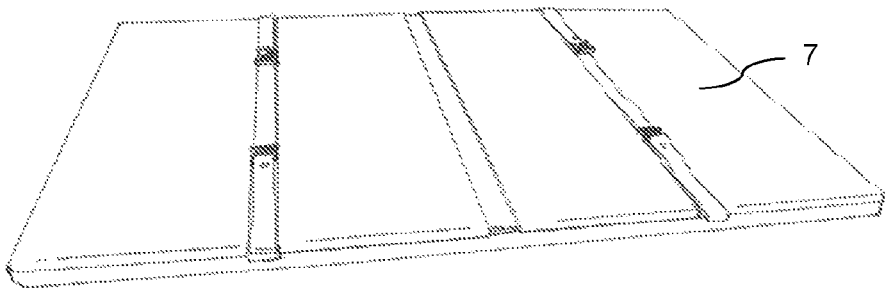
Figure 12:
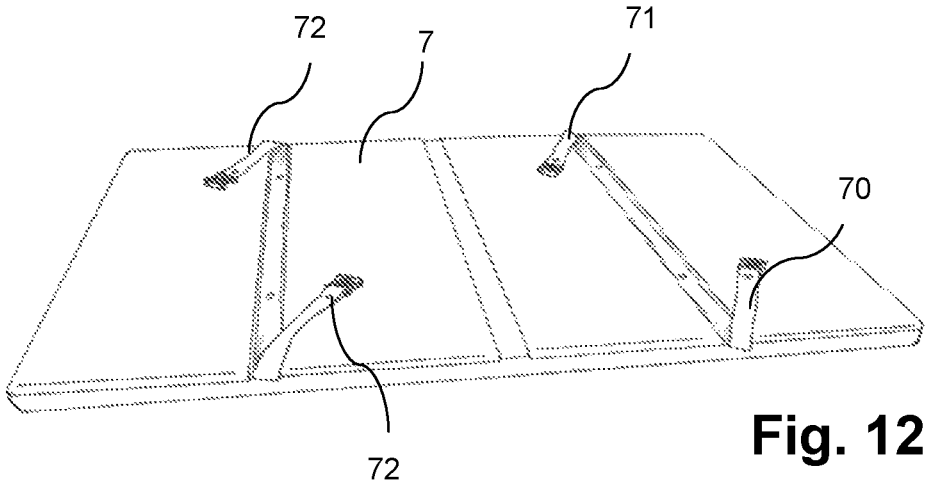
Figure 13:
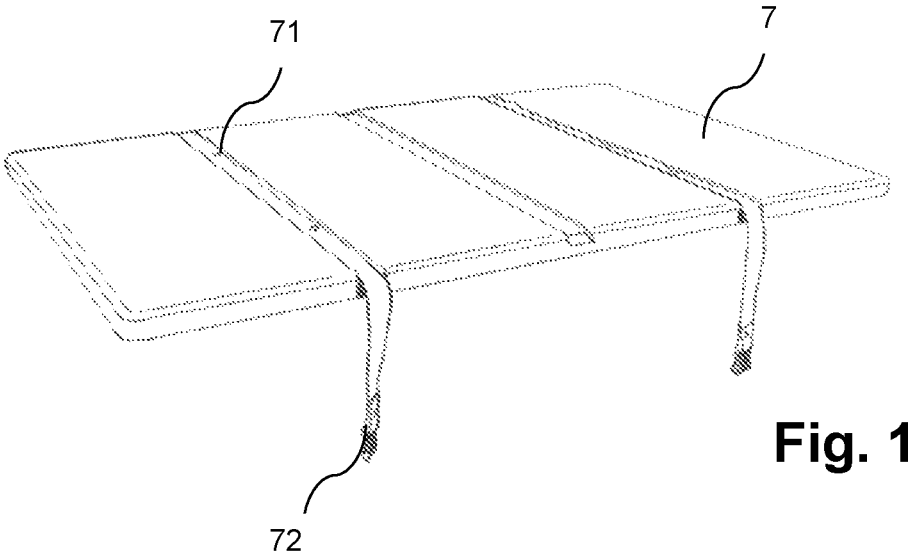
Figure 14:
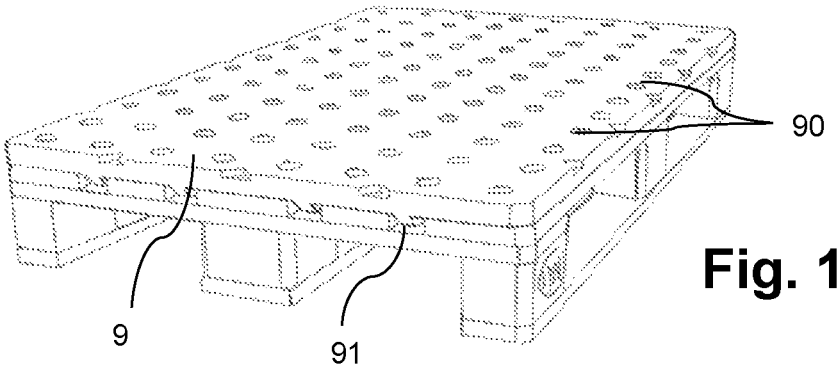
Figure 15:
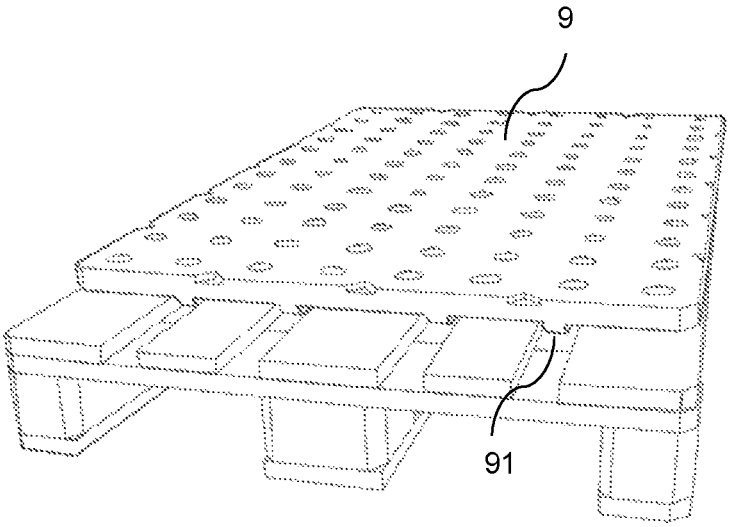
Figure 16:
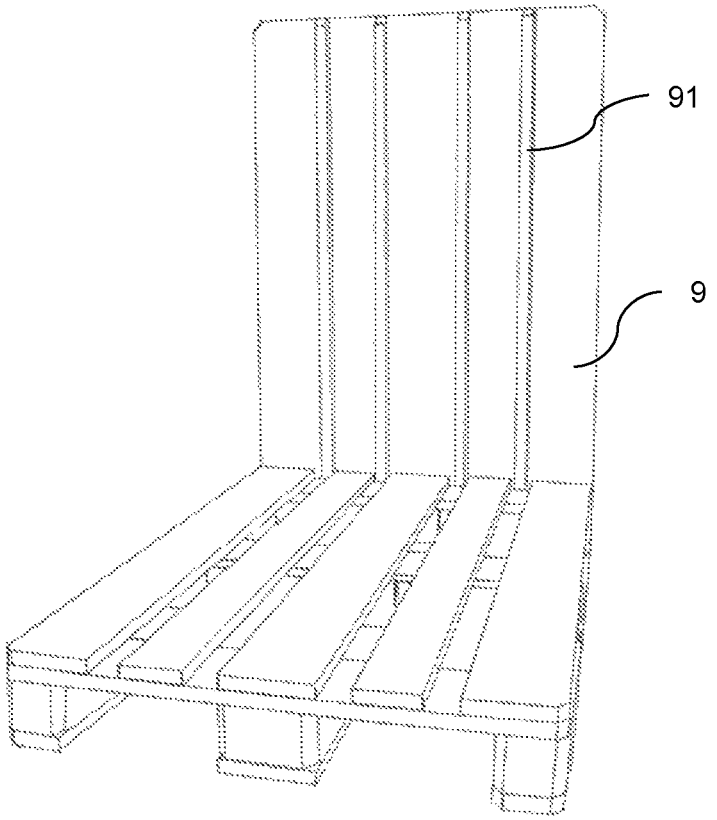
Figure 17:
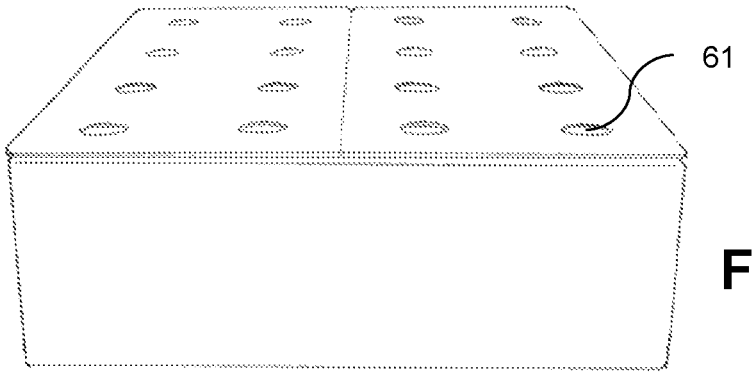
Figure 18:
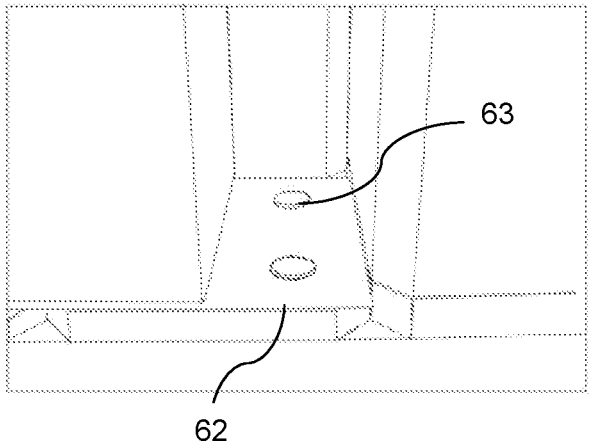
Figure 19:
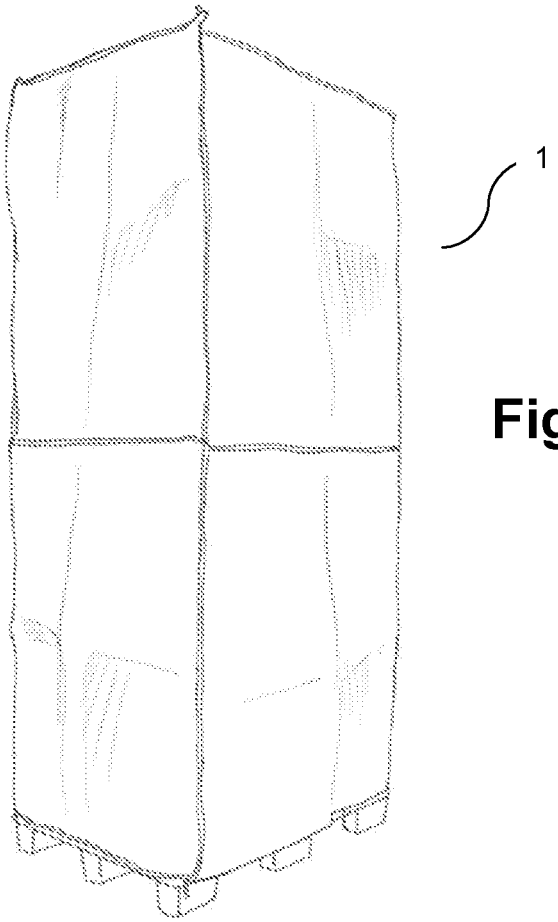

FIGS. 11, 12, and 13 illustrate a third component of the system of the invention in three different conditions of use;

FIGS. 14, 15, and 16 illustrate a further component of the system of the invention;

FIGS. 17 and 18 illustrate an accessory of the system of the invention;

FIG. 19 illustrates a further accessory of the modular system of the invention.

DETAILED DESCRIPTION OF THE INVENTION

Figure 1:
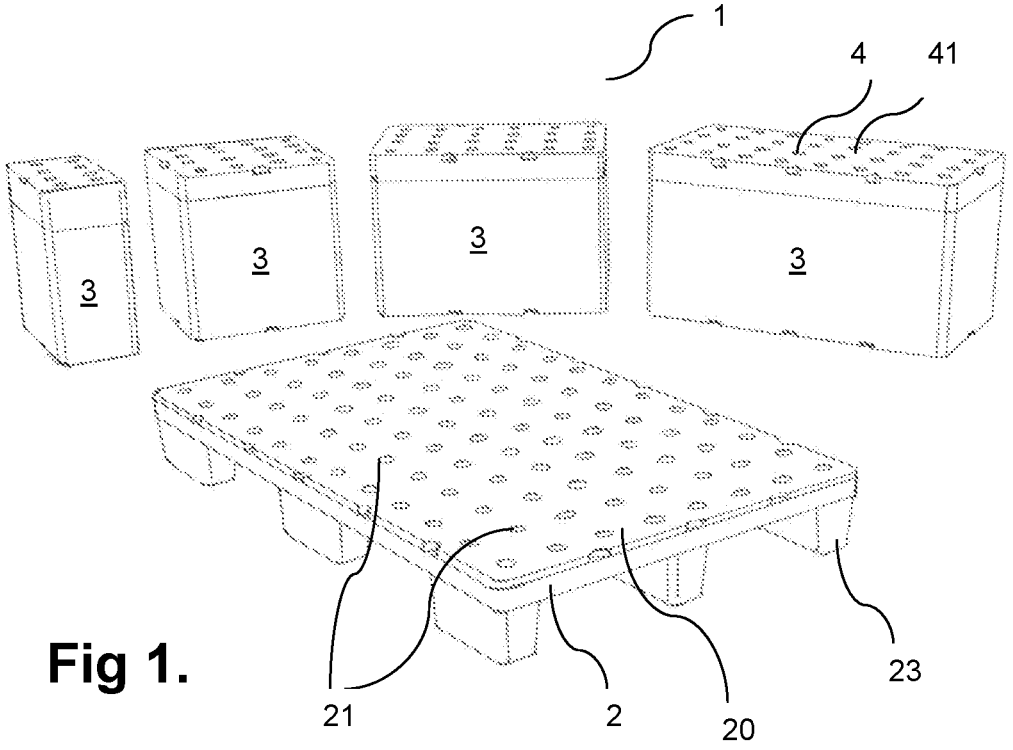
FIG. 1 is a schematic perspective view of a plurality of components usable in a modular packing system of the present invention.

In the above mentioned figures, and in particular in FIG. 1, number reference 1 globally indicates a pallet with relative boxes and containers of the modular packing system of the present invention prepared for packages of pharmaceuticals requiring transport under protected conditions.

The modular packing system of the invention comprises a pallet 2 made of EPS (expanded polystyrene) which is light in weight, easy to handle, and capable of supporting dynamic loads of over 600 kg.

Pallets can be constructed to resist loads of higher entity simply by utilizing higher density polystyrene. Furthermore, pallets may also be constructed in PPE (polypropylene).

Figure 2:
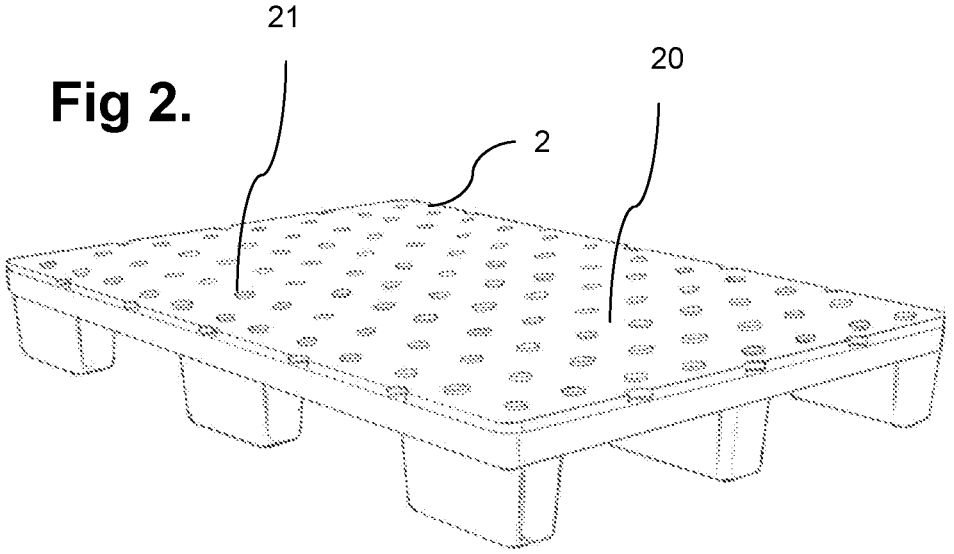
FIG. 2 is a perspective view of a component of the modular packing system of FIG. 1.
Figure 3:
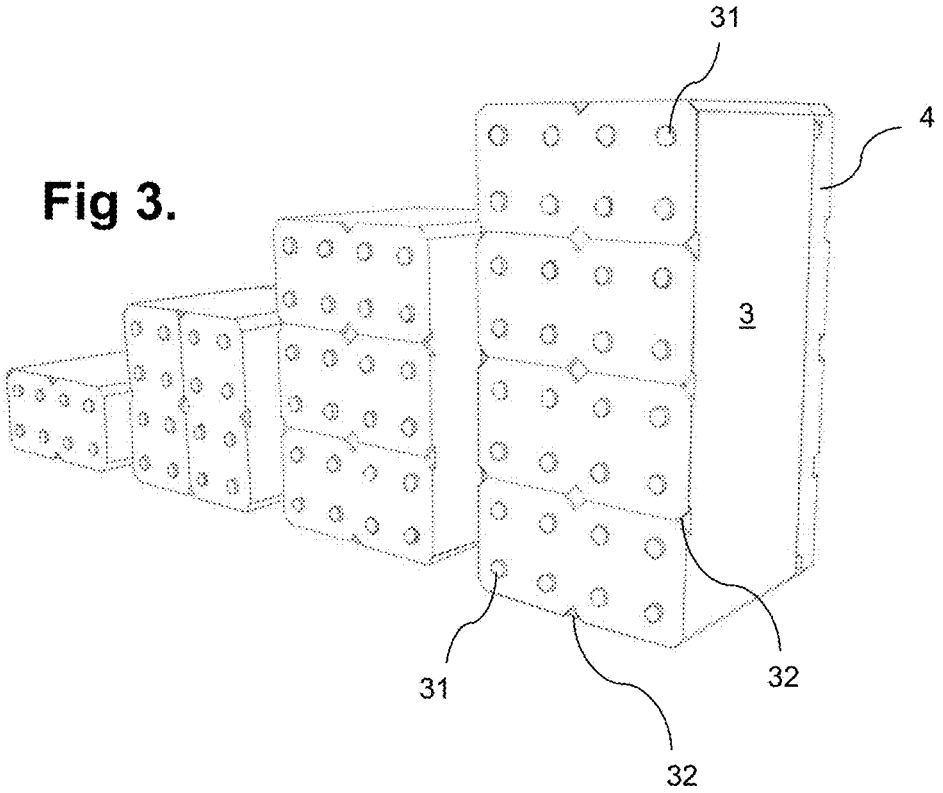
FIG. 3 is a perspective view of a second component of the modular packing system of FIG. 1.

The pallet 2 of the system of the invention comprises a continuous unperforated support surface 20, as illustrated in FIG. 2, exhibiting a plurality of seating features 21 regularly distributed on the surface. Furthermore, the pallet 2 exhibits support elements 23 located below the support surface and regularly distributed such as to evenly support a load distributed over the support surface. Furthermore, the support elements 23 are arranged such as to form a series of openings suitable for insertion of lifting fork elements of a lifting vehicle during handling and transport, in know manner, of the pallet and associated load.

In the present invention, pallets can be stacked using moulded interlocking elements.

In particular, pallets of the system of the invention are not subject to putrefaction, are recyclable, do not support growth of fungi, moulds, and/or anything else that might promote a transmission of viruses, parasites, or similar, are easy to wash, and do not absorb water or humidity.

Furthermore, when pallets become worn and/or damaged they can be recovered, ground, and formed into briquettes, the resulting materials being reusable for production of new pallets or for other processes and consequently no pollutant materials are put into circulation and require disposal, also bearing in mind that polystyrene is composed of 98% air.

In addition to the pallets described above, the modular system of the invention also comprises a plurality of containers 3. The base measurements of each container are submultiples of the dimensions of the pallet. For example: assuming a pallet support surface of 1200×800 mm, the containers exhibit base dimensions of 200×400, 300×400, 400×400, 600×400, 800×400, 600×800, and 1200×800 mm. Furthermore, if pallets exhibit different surface dimensions containers of appropriate dimensions will be provided such that the base measurements are always submultiples of the dimensions of the pallet support surface.

The height of each container format will be equal, for example, 425 mm. The format 1200×800 mm will have an overall height of 1000 mm. A constant or multiple height of containers makes it possible to form regular layers of containers at the same level as illustrated, for example, in FIGS. 6 and 7.

The containers indicated above make it possible to fully occupy the surface area of the pallet without wasting space, without packages extending outside the pallet perimeter, and without voids between boxes as often happens using pallets and boxes of known type.

In further detail, each container 3 is preferably made of expanded polystyrene but can also be made of polypropylene or of any other material exhibiting insulating properties.

In particular, a lower surface of the base 30, of each container 3, exhibits a plurality of uniformly distributed raised portions (31) exhibiting a configuration such as to engage in seating features 21 on the support surface.

Furthermore, the lower surface of the base of each container exhibits cavity elements 32 which extend as grooves in the vertical walls of the containers at regular intervals.

In the present invention, each container 3 exhibits bevelled vertical wall corners such as to form vertical ventilation channels between containers. In further detail, the corner channels serve the same function as the vertical wall grooves, as will be described herein below.

Figure 4:
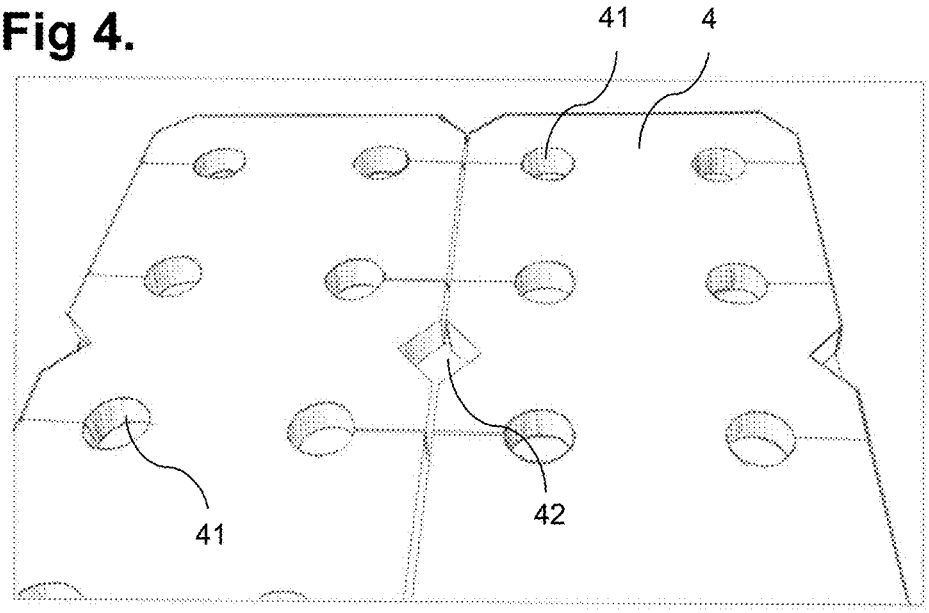
FIG. 4 is a plan view of a detail of the second component of FIG. 3.
Figure 5:
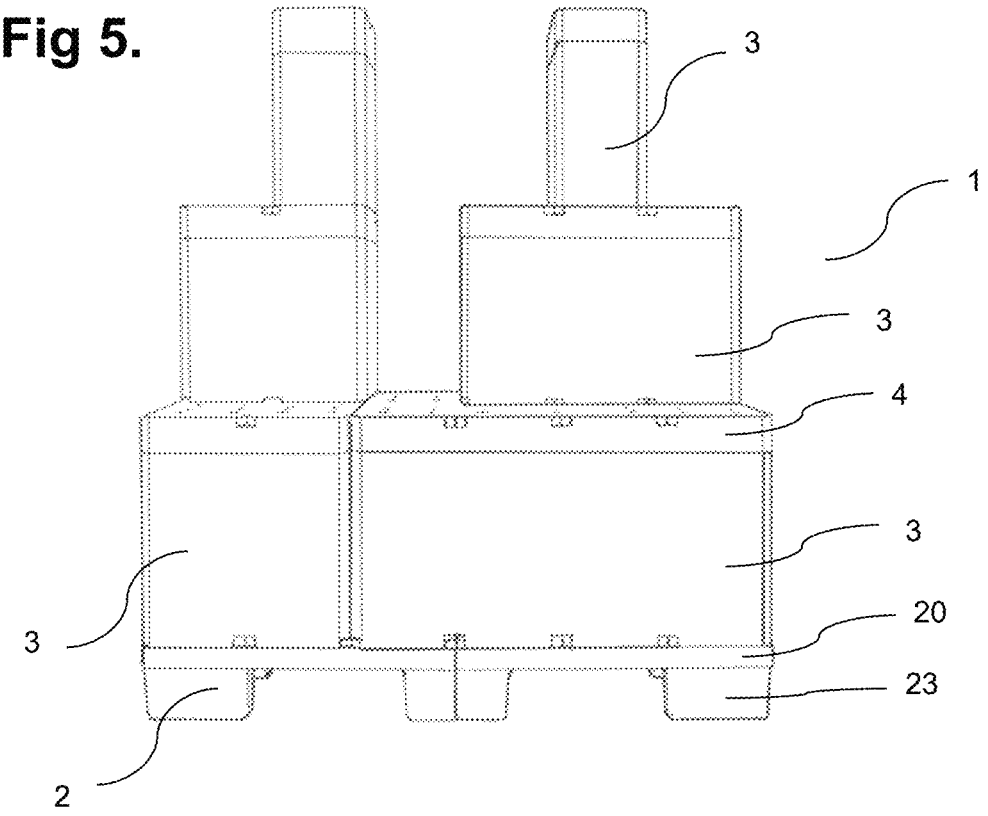
FIG. 5 is a perspective view of an assemblage of components of the packing system of the invention.

As illustrated in FIG. 4, the cover element 4 of each container exhibits a plurality of seating features 41, identical both in conformation and position to the seating features present on the pallet support surface, such as to form another support and engagement surface for a subsequent layer of containers positioned above. Furthermore, cavity elements 42 form extensions of the vertical channels. The vertical channels serve to permit air circulation between boxes and containers such as to maintain a constant temperature within a given range and to eliminate humidity if a pallet is wrapped in a thermal cover to insulate it from the external environment as illustrated in FIG. 19.

Maintenance of a temperature within a given range is achieved using heating or cooling systems of substantially known type.

Figure 10:
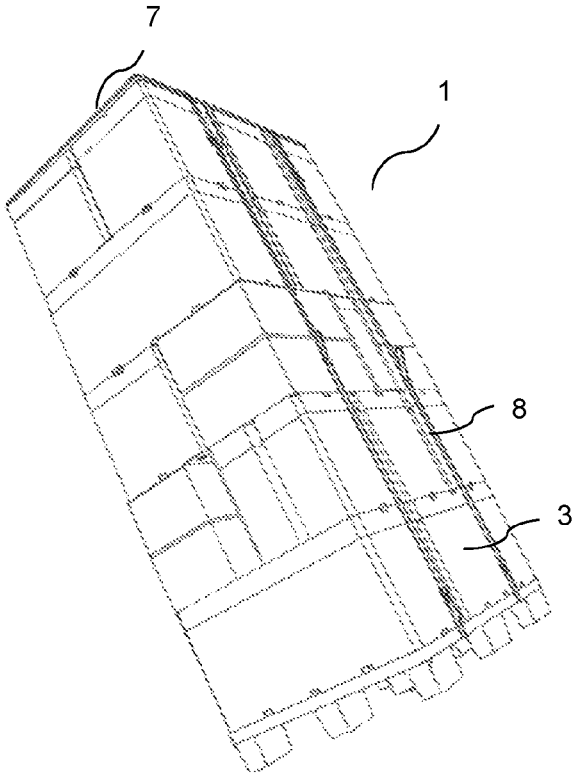
FIG. 10 illustrates the assemblage in operating conditions.

Containers are specifically conformed such that they reciprocally engage with each other, providing a high degree of stability, also vertically and even when a pallet is fully loaded, as illustrated in FIG. 10.

In the present system, containers 3 exhibit a code printed on each of the four vertical sides such as to facilitate recognition of container format.

The modular packing system provides a further possibility of engaging cardboard boxes to each other, to pallets, and to containers. The cardboard boxes used in the system of the invention exhibit base measurements which are submultiples of the pallet and preferably a height half that of containers such as to favour resistance to loading, however the latter parameter is not binding. The important factor is realization of uniform surfaces of consistent height as shown in FIGS. 6 and 8.

As illustrated in FIG. 17 and in greater detail, the upper and lower surfaces of the cardboard boxes exhibit a plurality of blind holes 61 distributed uniformly and at equal reciprocal distances, positioned such as to contact and engage with the raised features 31 on the lower surfaces of EPS containers. The blind holes 61 are formed in the box closure flaps. In further detail, each box closure flap exhibits a first portion in continuous cardboard corresponding to half a closure surface of a cardboard box and covering and protecting the contents of the cardboard box, and a second portion of the same dimensions, to exhibiting blind holes 61, folded back on top of the first portion such that the raised portions 31 of a container engage in the blind holes and form an interlock between the cardboard box and container.

Furthermore, when a box is placed on top of a container or another cardboard box, it is necessary to insert a panel 62 exhibiting protrusions 63 on both sides in order to permit interlocking, as illustrated in FIG. 18.

In detail, the protrusions are distributed such as to match the seating features of pallets and containers. It is in not necessary that all seating features are occupied.

The panel 62 can be made of cardboard or thermoformed plastic material and must exhibit a very limited thickness such as not to significantly increase the height of each layer of containers/boxes.

Figure 9:
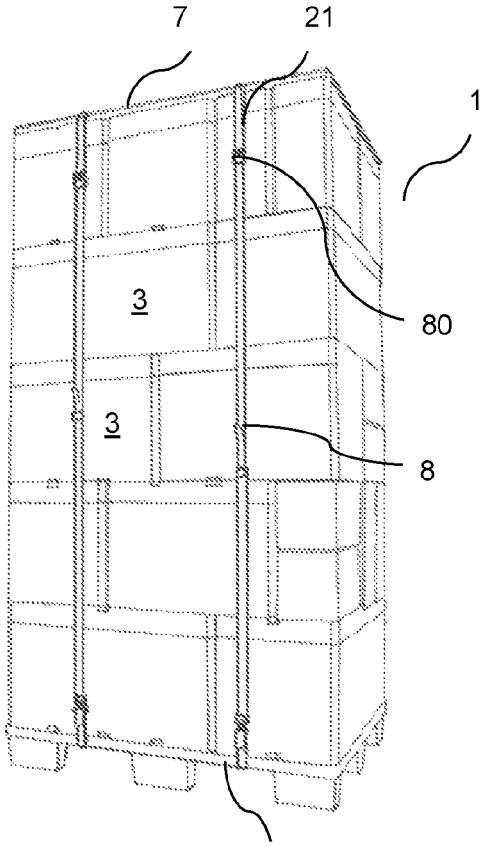
FIG. 9 is a different view of the assemblage of FIG. 8.

The system also foresees al uppermost cover element 7 which is positioned on top of a final layer of containers as illustrated in FIGS. 8 and 9.

The lower surface of an uppermost cover element 7 exhibits raised portions positioned such as to engage in seating features of containers or boxes, and an upper surface affording two small groove features 70 designed to receive a first pair of belts 71 provided with fixture elements 72 as illustrated in FIG. 13.

Short portions of the respective cover belts 71 are folded, as illustrated in FIG. 12, and fixed in position, as illustrated in FIG. 11. A lower surface of the cover element affords four cavities for housing folded belt fixture elements when cover elements are stacked together. Furthermore, cover elements exhibit seating features for stacking pallets on top of cover elements.

Analogously, pallets also exhibit two groove features for housing a second pair of belts and relative fixture elements, and again portions of the respective belts are folded and fixed in position.

The system of the invention comprises four belt portions 8 with relative attachments 80 designed to engage with the fixture elements of the belts on a pallet and cover element.

When a pallet is fully loaded, it is necessary to release the portions of belt and extend them outside of the cover element and then place the cover element on top of the final layer of containers, as illustrated in FIG. 13. Subsequently, each portion of belt 8 is engaged with the fixture elements of the pallet and cover element belts and pulled into tension such as to increase interlocking of containers between pallet and cover as illustrated in FIGS. 8 and 9.

A security system is foreseen for each belt such as to form a seal and closure that guarantees a pallet against tampering and theft.

The present invention includes an option, when handling heavy loads, of using approved wood pallets of known type equipped with dividing elements 9 made of EPS and exhibiting seating features 90 such as to engage with containers and on a lower surface exhibiting raised ridges 91 which insert between the lattice elements of a wood pallet as illustrated in FIGS. 14, 15, and 16. Belts are provided on the dividing element and not on the wood pallet. Furthermore, the dividing element 9 is equipped with fixing elements that prevent horizontal displacement of the dividing element on the wood pallet.

In the present embodiment, the modular packing system of the invention can be used with EPS containers described by the patent applicant in Italian Patent no. 1358620 and in Patent Applications no. MN2006A48 and no. MN2009A9, in addition to European Patent no. 1902262.

The descriptions provided above are essentially structural, while the operation of the invention is as follows.

When products must be transported under protected, safe, and stable conditions, for example pharmaceuticals, a user of the invention can simply fill various EPS containers with pharmaceutical packages and then close the containers. When the various containers are ready the packing operator locates a pallet and positions the containers, inserting the raised features 31 into the seating features 21 such as to form a first layer of containers without interspaces between containers and without portions of containers projecting outside the pallet profile. Once the first layer is complete, the operator proceeds in a similar manner to arrange a second layer of containers and so on until the desired final height is reached. At this point the pallet is ready for handling, considering that the pallet does not need to be wrapped in a plastic film, as would be the case using pallets and containers of known type, because the containers engage with each other and with the pallet support surface.

If required, the stability and in particular the resistance to tampering to of a pallet can be increased by fitting an uppermost cover element and engaging each of the four portions of belt 8 respectively to the first and second belts, engaging the respective fixture elements and attachments and tensioning the belts such as to solidly constrain the containers and boxes between the uppermost cover element and pallet support surface as illustrated in FIG. 10.

Finally, in order to provide a guarantee to a final user that a pallet was not tampered with during transport, the operator can close the belts with sealing elements which prove the integrity of the pallet.

In particular, when cardboard boxes need to be included on the pallet, the operator simply inserts panels 62 with raised features on the lower surfaces of the boxes such that the raised features can engage in the holes 61 of the boxes on one side and in the seating features 21 of the containers on the other side, as illustrated in FIG. 18. Furthermore, when a container must be positioned on top of a box, the raised features 31 of the container engage into the holes 61 in the upper surface of the box.

Finally, when products must be maintained within a given temperature range, a pallet and associated containers are enclosed in a thermal cover as illustrated in FIG. 19, air circulation in the channels between the containers being implemented using a heating or cooling system.

The present invention attains the proposed aims as described above.

The packing system of the invention provides optimum transportability of boxes containing pharmaceuticals or other delicate products in a safe, protected, and stable manner.

The modular system of the invention provides pallets, EPS containers, and cardboard boxes that interlock with each other, providing a relatively high degree of stability even when a pallet is fully loaded.

Advantageously, the system of the invention provides a good standard of preservation of products inside the containers and boxes, and good preservation of the aesthetic, structural, and hygienic condition of boxes, considering that humidity, fungi, and viruses or parasites cannot contaminate boxes during transport and storage.

Furthermore, the modular packing system provides a security seal for the pallet and associated containers, preventing tampering or removal of containers and thus offering final users a guarantee that a pallet was not altered if the uppermost cover element, belts and seals are present and intact.

A further advantage of the modular packing system of the invention emerges during pallet packing, the procedures being much faster, simpler, and safer than procedures of known type, permitting orderly stacking of various types of containers and boxes without compromising the characteristics of practicality, stability, and security and resulting in significant savings in time, labour, and costs.

The modular packing system is simple and practical and permits arrangement of boxes and containers on a pallet without elements projecting outside of the pallet profile and without wastage of space as commonly occurs using pallets and packages of known type.

Furthermore, the pallets of the present modular system prevent damage, wetting, or any form of deterioration of box and container bases because the pallets are continuous and unperforated.

A further advantage of the present system is the elimination of waste materials for disposal because pallets and containers can be reutilized and recycled when scrapped, thus avoiding waste materials for disposal and reducing operating costs. Using the present system drastically reduces transfer of pallets between suppliers and users because the same pallets are used both for empty containers, and full containers/boxes. Furthermore, the present system reduces occupation of space inside storage areas for stacking pallets prior to return, and the relative transport costs.

For an equivalent transport volume, the pallets of the invention are lighter than pallets of known type without requiring the felling of trees in order to produce the component wood slats, and no treatments are required for elimination of wood parasites.

A final but not least important advantage is the ease of use, simple construction, and excellent functionality of the present invention.

Obviously, numerous modifications and variants could be introduced to the present invention without going outside the range of the invention as claimed below.

The invention claimed is:

1. A modular packing system, comprising:

a pallet base element comprising a continuous unperforated support surface exhibiting a plurality of first seating features distributed uniformly over the continuous unperforated support surface, the pallet base element also comprising support elements located below the support surface and regularly distributed to evenly support a load distributed over the support surface, the support elements forming a series of openings for insertion of lifting fork elements of a lifting vehicle for transport of the pallet base element;

a plurality of containers, base dimensions of the plurality of containers being submultiples of base dimensions of the pallet base element and having a constant height to form uniform layers of the plurality of containers of a same height, each container of the plurality of containers exhibiting a base lower surface provided with a plurality of uniformly distributed raised portions to engage with the plurality of first seating features in the support surface, the plurality of containers being provided with a cover element having a plurality of second seating features identical in conformation and position to the plurality of first seating features in the continuous unperforated support surface, to form a further support and engagement surface for positioning thereon a subsequent layer of the plurality of containers;

an uppermost cover element, positioned on top of a final layer of the plurality of containers, an uppermost surface of the uppermost cover element having two grooves receiving a first pair of belts provided with fixture elements, minor portions of the first pair of belts being folded and fixed in position, and a plurality of seating features for stacking a pallet on top of the uppermost cover element, while a lower surface of the uppermost cover element has a plurality of raised portions, engaged in a plurality of second seating features of underlying plurality of containers of the plurality of containers, and four cavities for housing folded attachment elements of the first pair of belts when a plurality of uppermost cover elements are stacked together;

a second pair of belts with relative attachment elements housed in two grooves in the pallet base element, the second pair of belts being partially folded and fixed in position; and four belt portions with corresponding attachments designed to engage with attachments of the first and second belts of the uppermost cover element and pallet base element, wherein the four belt portions with the corresponding attachments and the attachments of the first pair of belts and the second pair of belts, when locked, form a seal and closure that protects the pallet base element and plurality of containers from acts of tampering and theft.

2. The modular packing system of claim 1, wherein cardboard boxes engage to each other, to the pallet base element, and to the plurality of containers, the cardboard boxes exhibiting base measurements that are submultiples of the pallet base element and a height that is half the height of the plurality of containers to optimize resistance to loading and form layers of uniform height.

3. The modular packing system of claim 2, wherein upper and lower surfaces of the cardboard boxes have a plurality of blind holes distributed uniformly and at equal reciprocal distances, positioned to engage with the plurality of uniformly distributed raised portions on the base lower surface of the plurality of containers, the blind holes being located in cardboard box closure flaps, wherein each cardboard box closure flap has a first portion of continuous cardboard corresponding to half a side surface of the cardboard box and covering and protecting the contents of the cardboard box, and a second portion of same dimensions of the first portion and having the blind holes folding on top of the first portion such that the raised portions of a container of the plurality of containers engage in the blind holes to form an interlock between the cardboard box and the corresponding container of the plurality of containers.

4. The modular packing system of claim 2, further comprising a panel of cardboard or of thermoformed plastic having protrusions on both major faces, distributed to correspond to positions of the plurality of first seating features and the plurality of second seating features of the pallet base element and of the plurality of containers and thus forming an interlock between a cardboard box positioned on top of a container of the plurality of containers or positioned on top of another cardboard box.

5. The modular packing system of claim 2, wherein the lower surface of a base of the plurality of containers has cavity elements which extend as grooves in vertical walls of the plurality of containers at regular intervals, and further cavity elements are provided on an uppermost cover element representing points of arrival of the vertical grooves, the grooves and cavities permitting air circulation between the cardboard boxes and the containers.

6. The modular packing system of claim 5, wherein the container has beveled vertical wall corners to form vertical ventilation channels between containers serving a same function as the vertical wall grooves.

7. The modular packing system of claim 1, further comprising a jacket designed to enclose the pallet base element and the plurality of containers to provide insulation from an external environment, protection from humidity, and maintain a constant temperature within a given range in the presence of heating or cooling systems.

8. The modular packing system of claim 1, further comprising a dividing element, made of polystyrene, having seatings to house the plurality of uniformly distributed raised portions of the plurality of containers, and a lower surface having raised ridges which engage between horizontal structural elements of a standard wood pallet, said dividing element being provided with belts, which are not present on a wood pallet, and fixing elements that prevent horizontal displacement of the dividing element on the wood pallet.

9. The modular packing system of claim 1, wherein the pallet base element is made of expanded polystyrene or polypropylene such that packing system is light and easy to handle, not subject to putrefaction, recyclable, not subject to the development of fungi, moulds, and/or anything that causes the formation and transmission of viruses or parasites, and is also easy to clean and does not absorb water or humidity.

10. The modular packing system of claim 1, wherein the plurality of containers engage to each other as a result of a special structural conformation, providing stability, also vertically and when the pallet base element is fully loaded.

11. A packing method using a modular packing system of claim 1, comprising the following operational stages:

preparing the plurality of containers for inserting products for transport and closing of container covers;

providing the pallet base element;

positioning the plurality of containers on the pallet base element including insertion of the raised elements of the plurality of containers into seating features of the pallet base element to form a first layer of the plurality of containers without spaces between the plurality of containers and without projection of portions of the plurality of containers outside of a pallet base element profile;

arranging the plurality of containers on a second and further levels to achieve a required total height;

fitting a cover on top of the uppermost layer of the plurality of containers, after having released and extracted the belt sections from the cover;

connecting each attachment element to a corresponding attachment element of each belt and belt portion;

tensioning of each belt to increase a degree of fixture of the plurality of containers between the pallet base element and the uppermost cover; and activating the seal and the closure that protects the pallet base element from acts of tampering and theft.

12. The packing method of claim 11, further comprising the following additional operative stages:

applying panels exhibiting raised features onto the lower surfaces of cardboard boxes to be packed on the pallet base element, such that the raised features engage into blind holes in underlying cardboard boxes or into seating features of the plurality of containers; and engaging the blind holes on the upper surface of a cardboard box with the raised features of a container of the plurality of containers when the container is packed on top of the cardboard box.

13. The modular packing system of claim 1, wherein the pallet base element is formed from expanded polystyrene.

14. The modular packing system of claim 1, wherein the pallet support surface is 1200×800 mm, and the containers exhibit base dimensions of 200×400 mm, 300×400 mm, 400×400 mm, 600×400 mm, 800×400 mm, 600×800 mm or 1200×800 mm.

15. The modular packing system of claim 14, wherein the height of each container of the plurality of containers is 425 mm.

16. The modular packing system of claim 1, wherein each container of the plurality of containers exhibits a code printed on four vertical sides so as to facilitate recognition.

* * * * *